US006036555A

United States Patent [19]

Takacs

[11] Patent Number: 6,036,555

[45] Date of Patent: Mar. 14, 2000

[54] ONE-HAND HELD FLOAT DRIVE

[76] Inventor: John Takacs, 519 May Valley Dr., Apt 1, Fenton, Mo. 63026

[21] Appl. No.: 09/044,431

[22] Filed: Mar. 19, 1998

[51] Int. Cl.[7] ..... B63H 19/00

[52] U.S. Cl. ..... 440/6; 441/129

[58] Field of Search ..... 114/315; 440/6; 441/129–132

[56] References Cited

U.S. PATENT DOCUMENTS

| | | | |
|---|---|---|---|
| 2,543,078 | 2/1951 | Varney | 114/315 |
| 3,034,467 | 5/1962 | Pestronk . | |
| 3,123,840 | 3/1964 | Cefalo, Jr. . | |
| 3,324,488 | 6/1967 | Schulz, Jr. . | |
| 3,441,952 | 4/1969 | Strader . | |
| 3,635,188 | 1/1972 | Rutkowski . | |
| 3,684,480 | 8/1972 | Peroni . | |
| 3,748,672 | 7/1973 | Patrick et al. | 441/131 |
| 3,789,792 | 2/1974 | Smith . | |
| 3,916,814 | 11/1975 | Bardoni et al. . | |
| 4,367,689 | 1/1983 | Lukehart et al. . | |
| 4,614,900 | 9/1986 | Young | 440/6 |
| 4,700,654 | 10/1987 | Borges . | |
| 4,729,331 | 3/1988 | Eggleston | 441/130 |
| 4,864,959 | 9/1989 | Takamizawa et al. | 114/315 |
| 4,911,094 | 3/1990 | Akers . | |
| 4,938,722 | 7/1990 | Rizley . | |
| 5,024,178 | 6/1991 | Bruce | 114/315 |
| 5,105,753 | 4/1992 | Chih et al. | 114/315 |

*Primary Examiner*—Sherman Basinger
*Attorney, Agent, or Firm*—Polster, Lieder, Woodruff & Lucchesi, L.C.

[57] ABSTRACT

In combination, a floating structure supporting a person in a prone or sitting position, a propelling unit includes a casing with a handle mounted on it, the propelling unit being manipuable by one hand of the person on the floating structure, and a lanyard connected to the propelling unit and floating structure in such a way as to permit the propelling unit as a whole to be manipulated angularly and translationally by the hand of the person supported by the floating structure.

6 Claims, 4 Drawing Sheets

ONE-HAND HELD FLOAT DRIVE

CROSS-REFERENCE TO RELATED APPLICATIONS

None

STATEMENT REGARDING FEDERALLY SPONSORED RESEARCH OR DEVELOPMENT

Not Applicable.

BACKGROUND OF THE INVENTION

Many devices have been proposed for propelling a small floating structure in which a person is seated or in which a person is lying down, see U.S. Pat. Nos. 3,123,840, 3,324,488, 4,911,094, 4367,689 or 4,938,722. Other propelling devices have been proposed either to be mounted on a person, as in U.S. Pat. Nos. 4,700,654, 3,635,188 or 3,034,467, or adapted to be grasped with two hands by a swimmer or diver as in U.S. Pat. Nos. 3,441,952, 3,685,480, 3,789,792 or 3,916,814. None of these has suggested devices that can be manipulated by one hand of a person sitting or lying on a floatable structure, in such a way as to permit the propelling devices to be manipulated angularly and translationally by each hand, and to preclude its inadvertent slipping beyond one's grasp, or sinking.

BRIEF SUMMARY OF THE INVENTION

In accordance with this invention, generally stated, in combination with a floating structure supporting a person in a prone or sitting position, propelling units are provided, each comprising a casing, a closure and a handle, the propelling unit being manipulable by one hand of the person, and means, for example, a lanyard, for connecting the propelling unit to the floating structure in such a way as to permit the propelling unit as a whole to be manipulated angularly and translationally by that one hand. Preferably, the propellant unit contains sufficient air within it so that it floats. In the preferred embodiments, the handle is integral the closure, and a switch in the handle is electrically connected, when the closure is mounted on the casing, to a battery and to a motor within the casing. The switch can be of a variable resistance type or other types by which the speed of the motor can be varied selectively.

DETAILED DESCRIPTION OF THE INVENTION

Figure 6:
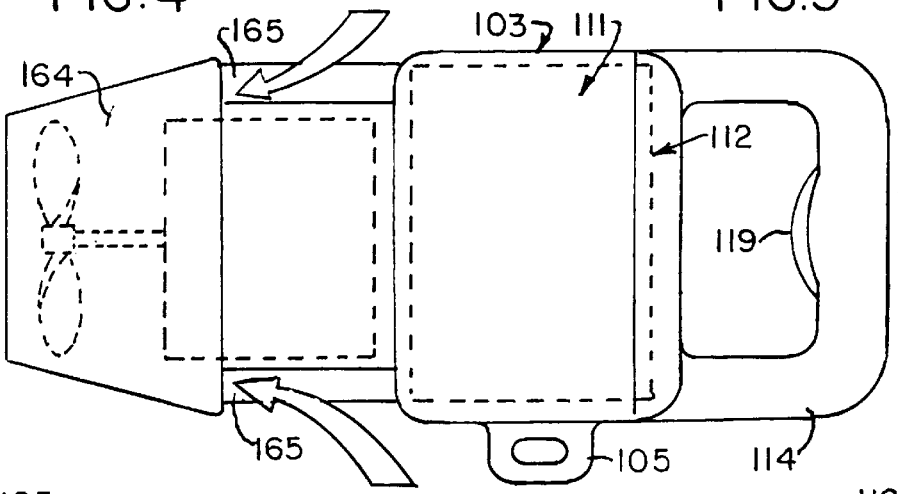
FIG. 6 is a view in side elevation of another embodiment of propelling unit of this invention.

Referring now to FIGS. 1–5 for one illustrative embodiment of this invention, reference numeral 1 indicates an inflatable raft, in which a person 2 is lying. A propellant device 3 of this invention along each long side of the raft is connected to the raft 1 by means of a lanyard 4 secured at one end to an eye or ring 5 on the device, such as is shown in FIGS. 6, for example, and on another end, to a ring on the raft. The rings on the raft can be mounted on a Velcro (hook and loop) strap encircling the raft or to pads adhered or otherwise secured to the sides of the raft. The propellant device 4 of this embodiment includes a casing 11 and a closure 12. The closure 12 has integral with it a handle 14. The closure 12 has a rim 16 with internal threads 17. The handle has, mounted in it, a switch 19, which can be of a variable resistance type, with a plunger 20, and terminals 21 and 22. Two electrical conductors 23 and 26 are connected to terminals 21 and 22 respectively at one end, and to a radially outer ring of conductive material 25 such as copper and a radially inner ring of electrically conductive material 24, respectively, the rings 24 and 25 being mounted on an inner surface of the closure 12, concentrically but electrically insulated from one another.

The casing 11 has at a large mouth area, two bosses 28, in open mouthed tubes of which an inner ring contact 30 and an outer ring contact 31 are slidably mounted. Each of the contacts 30 and 31 has a finger 33, an outer end of which engages one of the rings, a barrel 34, and a spring 36. The inner and outer ring contacts are spring biased toward their respective rings, by the springs 36. One electrical conductor 37 runs from the innermost contact 30, with which it is in sliding electrical contact, to one terminal 39 of a battery 40. Another electrical conductor 37 is electrically connected to a second terminal 41 of the battery 40, and to a brush of a commutator 44 of a motor 45. Another electrical conductor 46 is electrically connected to a brush that engages the commutator 44, at one end and, at another end, electrically connected to the outer ring contact 31.

The motor 45 has a motor shaft 47, with a gear meshing with other gears of a gear train to provide a desired speed of rotation to a propeller shaft 51, on which a propeller 50 is mounted.

The casing 11 has at its wide mouthed end external casing threads 55, complementary to the internal threads 17 of the closure 12. An O-ring 57 is mounted between facing surfaces of the casing and closure, as shown in FIG. 3, to ensure a water-tight seal.

An internal, radially extending wall or baffle 59 serves as a support for the battery 45, and also, for the motor shaft 47 on the outboard side of the motor, and second and third internal radially extending walls or baffles serve to support the motor shaft 47, the propeller shaft 51, and an intermediate gear shaft 52.

Figure 1:
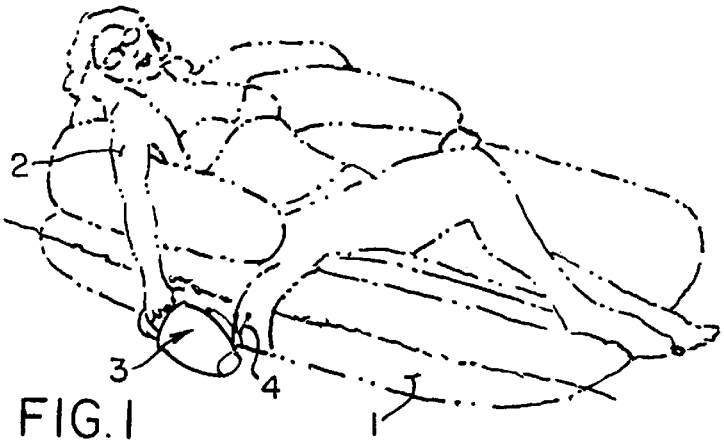
FIG. 1 is a device of this invention in use with an inflatable raft.
Figure 2:
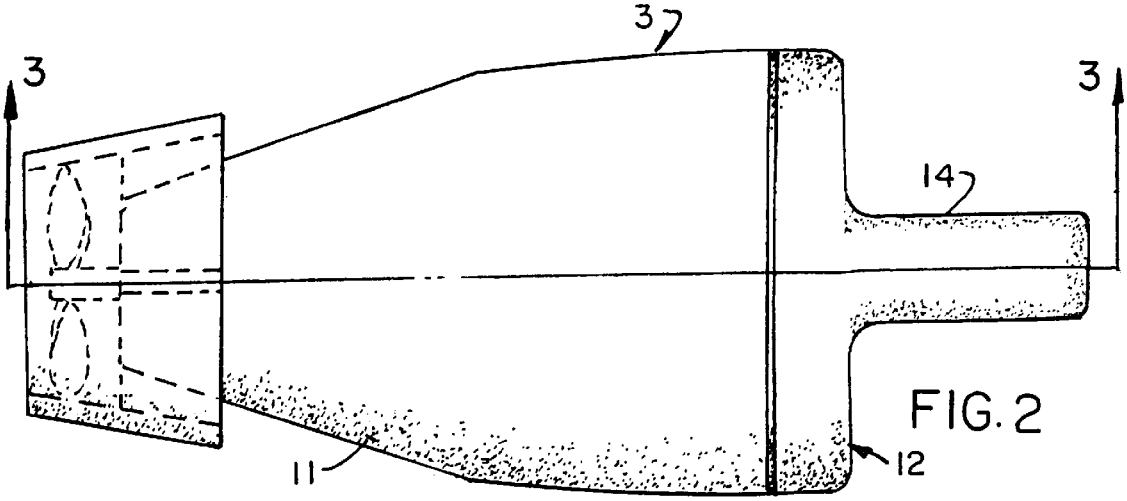
FIG. 2 is a view in side elevation of one embodiment of this invention.
Figure 3:
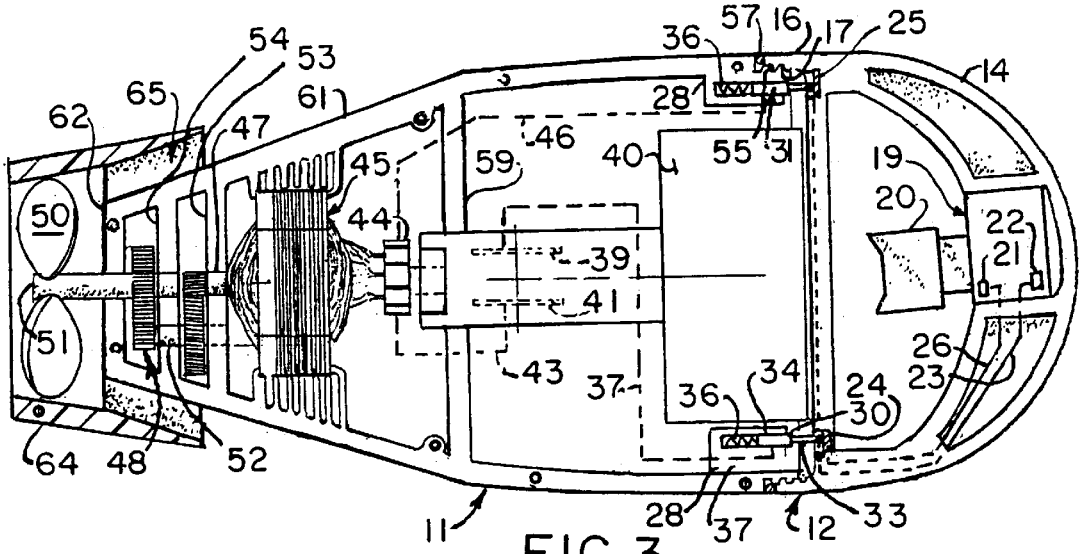
FIG. 3 is a sectional view taken along the line 3—3 of FIG. 2.
Figure 4:
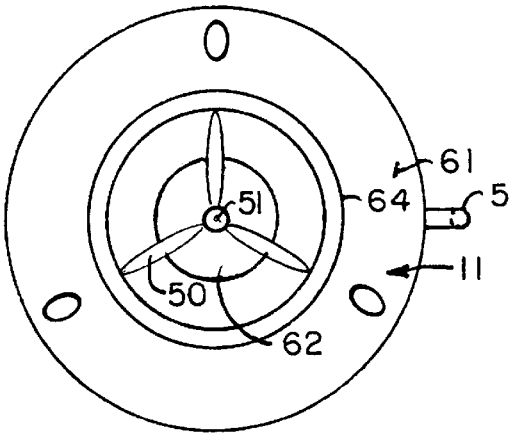
FIG. 4 is an view in end elevation, viewed from left to right of FIG. 2.
Figure 5:
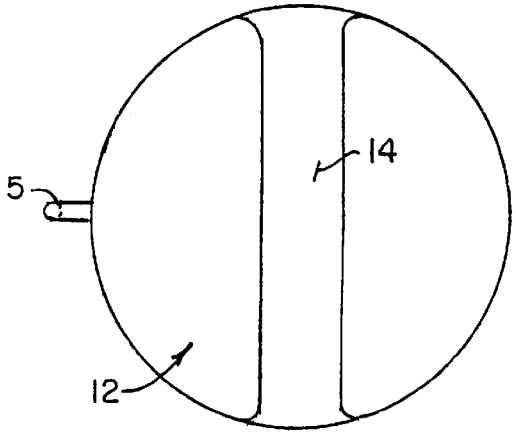
FIG. 5 is a view in end elevation from right to left of FIG. 3.

As is indicated in the drawings, FIG. 3, the shell or casing 11 is conveniently made in two halves, joined in any suitable way. It can be appreciated that it is not necessary to disassemble the casing 11 to remove and replace a battery, because this can be accomplished by unscrewing the closure and sliding the battery out of the open mouth.

Preferably the battery 40 is a rechargeable type, and, to this end, a plug-in jack or other suitable means can be provided for connecting the battery to a charger, as described in U.S. Pat. No. 3,916,814. Alternatively, a spent battery can easily be removed for recharging and a fresh battery installed, so that the device need not be taken out of service for recharging.

The propeller shaft 51 passes through a flat end wall 62, at the free end of a frustro-conical section 61 of the casing.

A shroud 64, spaced from the frustro conical section 61, is spaced from the section 61 by spaced, axially extending walls making up a spider 65, to permit free access of water through the passages defined by the spider 65 between the outer surface of the conical section 61 and the inner surface of the shroud 64. The shroud extends beyond the closed end 62 of the casing a distance sufficiently far to surround the propeller 50.

Suitable seals, such as labyrinth seals, surround the shaft 47 as it passes through the wall 53, and the propeller shaft as it passes through the flat end wall 62.

The switch 19 can be either of the resistor type, or of the type described in U.S. Pat. No. 4,700,564.

Figure 7:
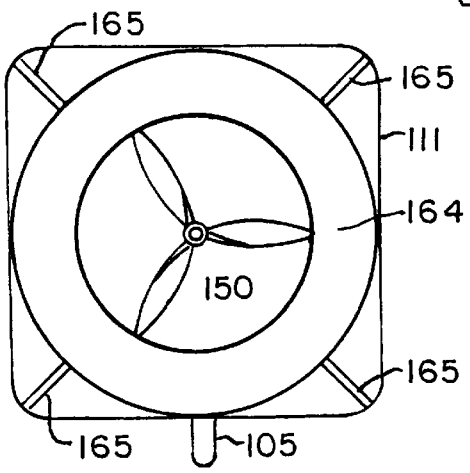
FIG. 7 is a view in end elevation, viewed from left to right of FIG. 6.
Figure 8:
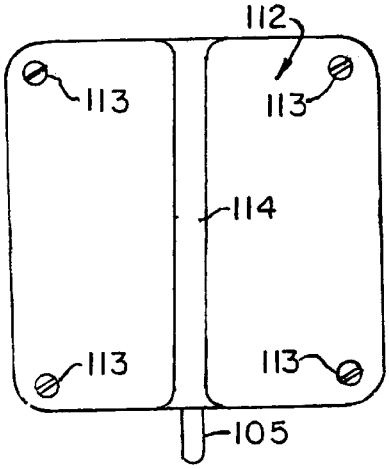
FIG. 8 is a view in end elevation view from right to left of FIG. 6.

Referring now to FIGS. 6, 7, and 8 for a second embodiment of this invention, reference numeral 103 indicates a propellant device, this one square in end elevation.

The device 103 has a casing 111 with a closure 112, which, in this case, is mounted to the casing 111 by means of screws 113 received into suitable bosses on the inside of the casing 111. The closure 112 has, integral with it, a handle 114, with a variable speed switch 11 9 mounted in it. An open ended frustro-conical shroud 164 is supported by pins 165 while permitting the free flow of water as indicated by the arrows, through the inside of the shroud 164.

The battery, motor and gearing arrangements can be substantially the same as those of the first embodiment, as shown in FIG. 3.

The batteries suitable for use in these propellant devices vary in size and shape. The casing of the second embodiment better accommodates square batteries and motors with square stators.

Figure 11:
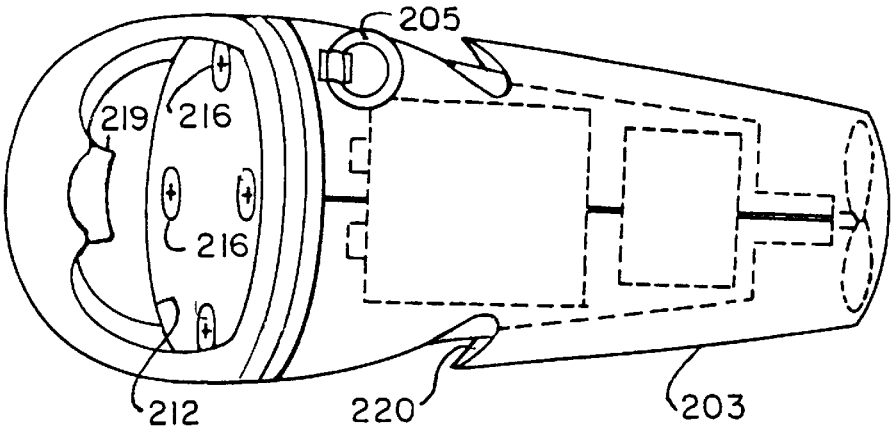
FIG. 11 is a view in perspective of modification of the device shown in FIGS. 9 and 10.
Figure 9:
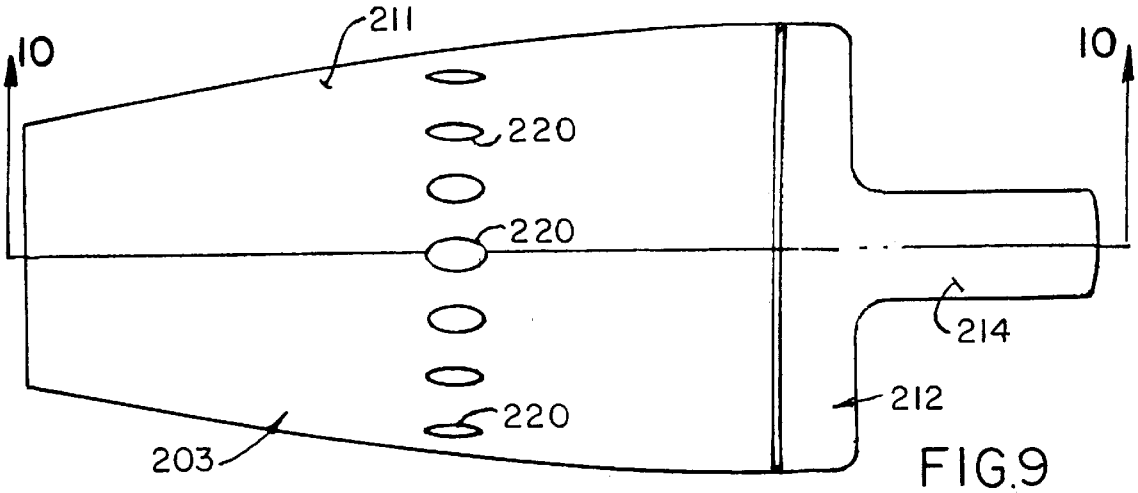
FIG. 9 is a view in side elevation of yet another embodiment of propelling unit of this invention.
Figure 10:
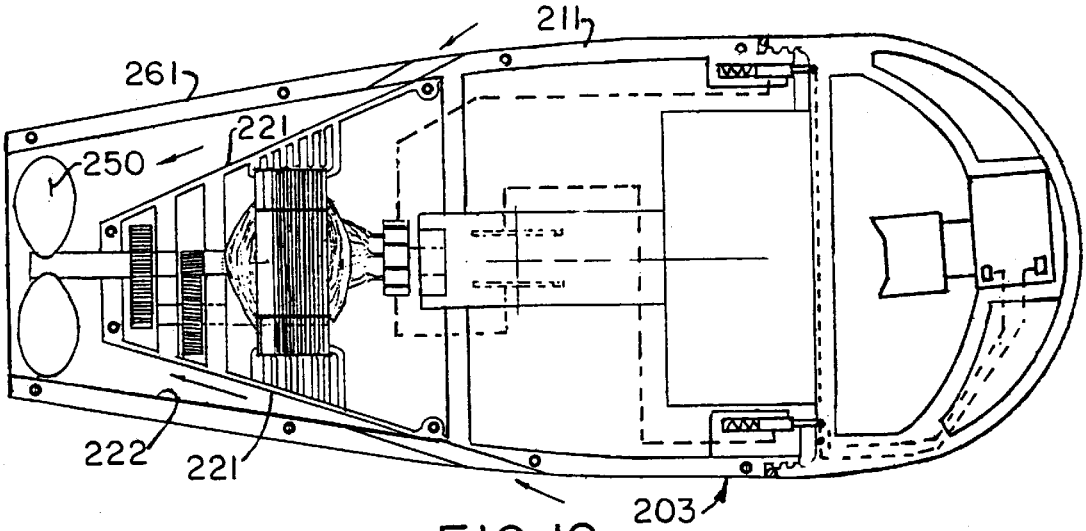
FIG. 10 is a sectional view taken along the line 10—10 of FIG. 9.

Referring now to FIGS. 9, 10 and 11 for yet another embodiment of the device of this invention, reference numeral 203 indicates a propellant device with a casing 211 and a closure 214 with a handle 214. In this embodiment, a frustro-conical section 261 of the casing 211 extends beyond a propeller 215, and forms in effect a shroud around an inner funnel shaped frustro-conical wall 221, as shown particularly in FIG. 10, leaving a flow space 222 to which water has access through ports 220. As indicated in FIG. 10, the arrangement of battery, motor and gearing inside the casing 211 can be identical to that of the same parts in the first embodiment.

The casing and shroud are preferably molded of a tough but light, impact-resistant material such as phenolic resin, polyurethane, polyvinyl chloride, polyurea, polypropylene and the like (see, for example, U.S. Pat. No. 3,916,814 Col. 2, lines 65–68). Merely by way of example, the propellant device of this invention can be about eleven inches long, six inches in diameter at its largest point, and three inches in diameter at it discharge end.

Figure 12:
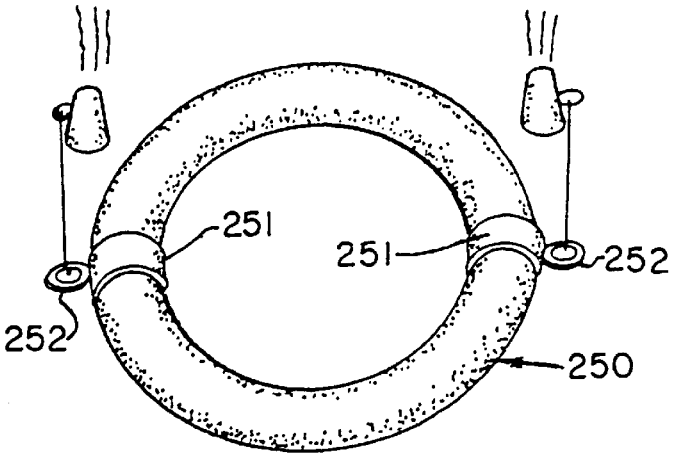
FIG. 12 is a view in perspective of a circular tube to which two of the devices are attached.
Figure 13:
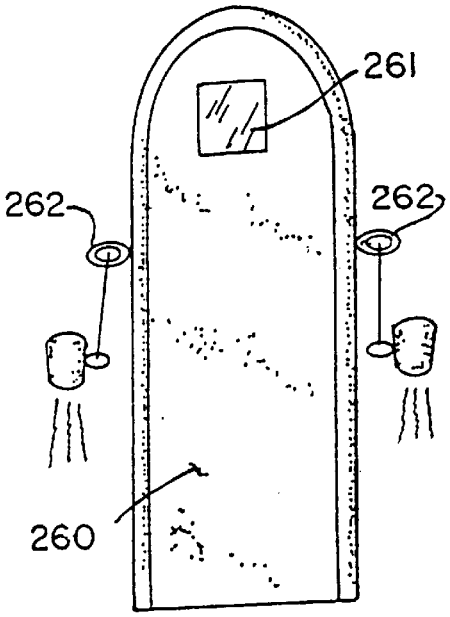
FIG. 13 is a top plan view of a belly board with viewing panel, to which two of the devices are attached.
Figure 14:
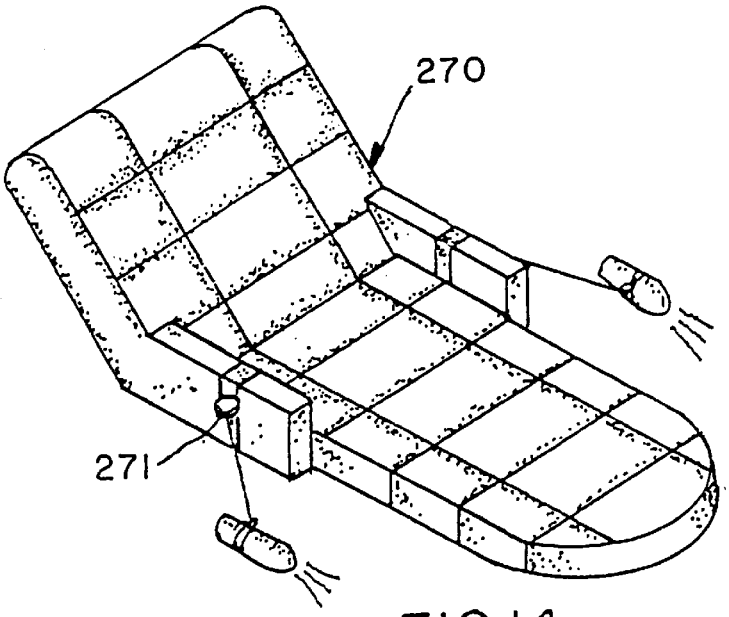
FIG. 14 is a view in perspective of a floating chair to which two of the devices are attached.
Figure 16:
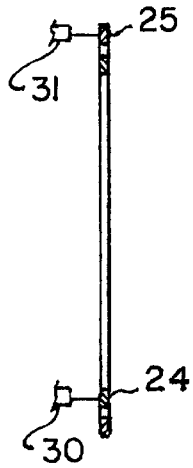
FIG. 16 is a diametric sectional view of contract rings shown in FIG. 3.
Figure 15:
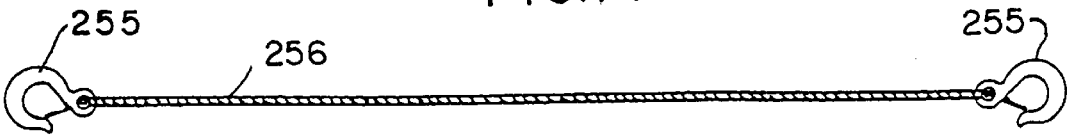
FIG. 15 is a top plan view of an elastic, bungee cord type of fastening element by which the device is attached to a floating structure as illustrated in FIGS. 12–14.

Referring now to FIGS. 12–14, FIG. 12 illustrates a floating structure in the form of a circular "innertube" 250, to which devices of this invention are attached on diametrically opposite sides by means of a strap 251, which can be a Velcro (hook and loop) strap pulled tight, or a cloth or rubber strip adhered to the tube, for example. In any event, it carries an eye 252 to which a device is connected, either by tying a lanyard or by means of snap hooks 255 on a bungee type elastic cord 256, illustrated in FIG. 15. FIG. 13 illustrates a belly board 260 with a transparent panel 261 set into it to permit underwater viewing, with eyes or rings 262 on opposite long sides, to which devices of this invention are connected. FIG. 14 illustrates a floating structure in the form of a chair 270, either inflated or made of closed cell flotation material such as foamed polyethylene, for example, with eyes 271 fastened to arms of the chair by which the devices are connected to the chair. In all of the floating structures, a person in them will normally be holding the propelling devices in the orientation shown in those figures, the discharge from the devices being in the direction shown in wavy lines. However, it can be appreciated that to steer the structure in a path different from the straight path indicated, the devices can be differently oriented, even directed in the opposite direction from that indicated.

Numerous variations in the construction of the device of this invention within the scope of the appended claims will occur to those skilled in the art in the light of the foregoing disclosure. Although the preferred embodiment of this device as shown in FIG. 11 as having screws holding the closure to the casing, in FIG. 11 and screw threads in FIG. 10, the threads of this embodiment are such as to permit the closure to be removed with a half turn of the closure after the screws are removed. Various other arrangements of screw threads and screws can be used. The configuration of handles and of the casing can be altered. The dimensions and configuration of the device can be varied, as long as the device remains manipulable by one hand of the user and can be moved in translation (up, down or sideways) or angularly, while still being tethered to the floating structure. The floating structure need not be one of the structures illustrated, but can be a raft of foamed plastic construction, or even an inflatable or otherwise buoyant garment or the like. Two devices can even be connected by means of a tether to a belt around an individual, who can float on his back, or swim beneath the surface. In every case, it is to be noted that by manually orienting the devices, one can propel the floatable structure or himself forwardly, backwardly, in circles or other patterns, or from side to side. By moving one device forward and the other aft, a tight turning radius can be achieved. The means for tethering the device can be a plastic (e.g. nylon or polyethylene) or cotton line, in place of the elastic cord such as a bungee cord indicated with at least one swivel snap, or any other flexible cord, light chain or the like. These are merely illustrative.

What is claimed is:

1. In combination with a floating structure adapted to support a person in a prone or sitting position, a completely self-contained propulsion unit comprising a casing, a closure and a single handle fixedly mounted on said propulsion unit, said handle adapted to be grasped by only one hand of a person, whereby said propulsion unit is manipulated solely by one hand, and a flexible elongated tether for tethering said propulsion unit to said floating structure in such a way as to permit the propulsion unit as a whole to be manipulated angularly and translationally with respect to said floating structure by one hand of a person supported by said structure, said casing housing a battery and an electric motor, and a switch in said handle electrically connected, when said closure is mounted on said casing, to said battery and said motor, said switch having a part positioned to be engaged by one hand grasping said handle.

2. The combination of claim 1 wherein the means for connecting the propulsion unit to the floating structure is a lanyard.

3. The combination of claim 1 wherein the propulsion unit contains sufficient air confined within it so that it floats.

4. In combination with a floating structure adapted to support a person in a prone or sitting position, a propulsion unit comprising a casing, a closure, and a handle mounted on said closure, said propulsion unit adapted to be held by and manipulable by one hand of a person, and means for connecting said propulsion unit to said floating structure in such a way as to permit the propulsion unit as a whole to be manipulated angularly and translationally by one hand of a person supported by said structure, said casing housing a battery and an electric motor, and a switch in said handle electrically connected, when said closure is mounted on said casing, to said battery and said motor, wherein said closure has an inside surface on which inner and outer electrically conductive rings are mounted, to which electrical conductors from said switch are connected, and said casing has spring-biased electric terminals each engaging one of said rings, said casing electric terminals being electrically connected to terminals of said battery by way of said motor.

5. The combination of claim 1 wherein the switch is a variable speed switch.

6. The combination of claim 1 wherein the handle is integral with said closure.

* * * * *